US005226777A

United States Patent [19]

Radev

[11] Patent Number: 5,226,777

[45] Date of Patent: Jul. 13, 1993

[54] LOAD LIFTING SYSTEM FOR VEHICLES

[75] Inventor: Vladimir Radev, Bristol, Va.

[73] Assignee: Simmons-Rand Company, Bristol, Va.

[21] Appl. No.: 662,409

[22] Filed: Feb. 28, 1991

[51] Int. Cl.[5] ..... B66F 9/00

[52] U.S. Cl. ..... 414/708; 414/715

[58] Field of Search ..... 414/700, 706–708, 414/710–713, 715

[56] References Cited

U.S. PATENT DOCUMENTS

| | | | |
|---|---|---|---|
| 2,835,397 | 5/1958 | Wagner | 414/711 |
| 3,024,927 | 3/1962 | Quayle . | |
| 3,038,619 | 6/1962 | Wagner | 414/711 |
| 3,059,792 | 10/1962 | Bernotas | 414/712 |
| 3,067,887 | 12/1962 | Quayle . | |
| 3,115,259 | 12/1963 | Wagner | 414/711 |
| 3,148,791 | 9/1964 | Kampert et al. | 414/707 |
| 4,249,854 | 2/1981 | Teti . | |
| 4,382,744 | 5/1983 | Klem et al. . | |
| 4,452,559 | 6/1984 | Speers et al. | 414/706 X |

FOREIGN PATENT DOCUMENTS

| | | | |
|---|---|---|---|
| 156465 | 10/1962 | U.S.S.R. | 414/711 |

*Primary Examiner*—Michael S. Huppert
*Assistant Examiner*—William M. Hienz
*Attorney, Agent, or Firm*—John J. Selko; James R. Bell

[57] ABSTRACT

Apparatus and system for loading and unloading a load onto and from a load carrying device mounted on a vehicle which is capable of producing a significant lift of the load and changing the angular position of the load at different load elevations. A bellcrank supports the load carrying device. A first pin pivotally mounts the bellcrank to the vehicle. A second pin pivotally mounts the load carrying device to the bellcrank. A first power device pivots the bellcrank around the first pin and a second power device pivots the load carrying device around the second pin.

5 Claims, 2 Drawing Sheets

LOAD LIFTING SYSTEM FOR VEHICLES

BACKGROUND OF THE INVENTION

This invention relates generally to vehicles and more particularly to load lifting systems for low-profile underground mining vehicles having a main frame and a load-carrying device attached to the main frame.

Low profile underground mining vehicles are well known in the art and include a main frame and a load-carrying device such as a scoop, a bucket, a flat platform, a fork, or another similar load-carrying device pivotally attached to the main frame of the vehicle. Usually the lower rear end of the load carrying device is attached pivotally to the lower front end of the main frame of the vehicle, and a pair of hydraulic cylinders are attached between the upper rear end of the load-carrying device and the main frame for pivoting the load-carrying device. Such an arrangement provides only tilting of the load-carrying device and has two major limitations: first, the lift of the load is very limited, and second, during a load-lifting operation the angular position of the load, referring to ground surface, changes continually and cannot be corrected. The foregoing illustrates limitations known to exist in present load lifting systems. Thus, it is apparent that it would be advantageous to provide a alternative directed to overcoming one or more of the limitations set forth above. Accordingly, a suitable alternative is provided including features more fully disclosed hereinafter.

SUMMARY OF THE INVENTION

In one aspect of the present invention, this is accomplished by providing a load lifting apparatus for vehicles having a main frame and a load carrying attachment mounted on the main frame. A support device is mounted on the main frame for supporting the load carrying attachment. A first mounting means is provided for pivotally mounting the support device on the main frame. A second mounting means is provided for pivotally mounting the load carrying attachment to the support device. A first power means is provided for pivoting the support device about the first mounting means and a second power means is provided for pivoting the load carrying attachment about the second mounting means.

The foregoing and other aspects will become apparent from the following detailed description of the invention when considered in conjunction with the accompanying drawing figures.

BRIEF DESCRIPTION OF THE DRAWING FIGURES

FIG. 1 is a partial top view of an underground mining vehicle including an embodiment of a load lifting system according to this invention; and FIG. 2 is a sectional view taken along the line 2—2 of FIG. 1.

DETAILED DESCRIPTION

Figure 1:
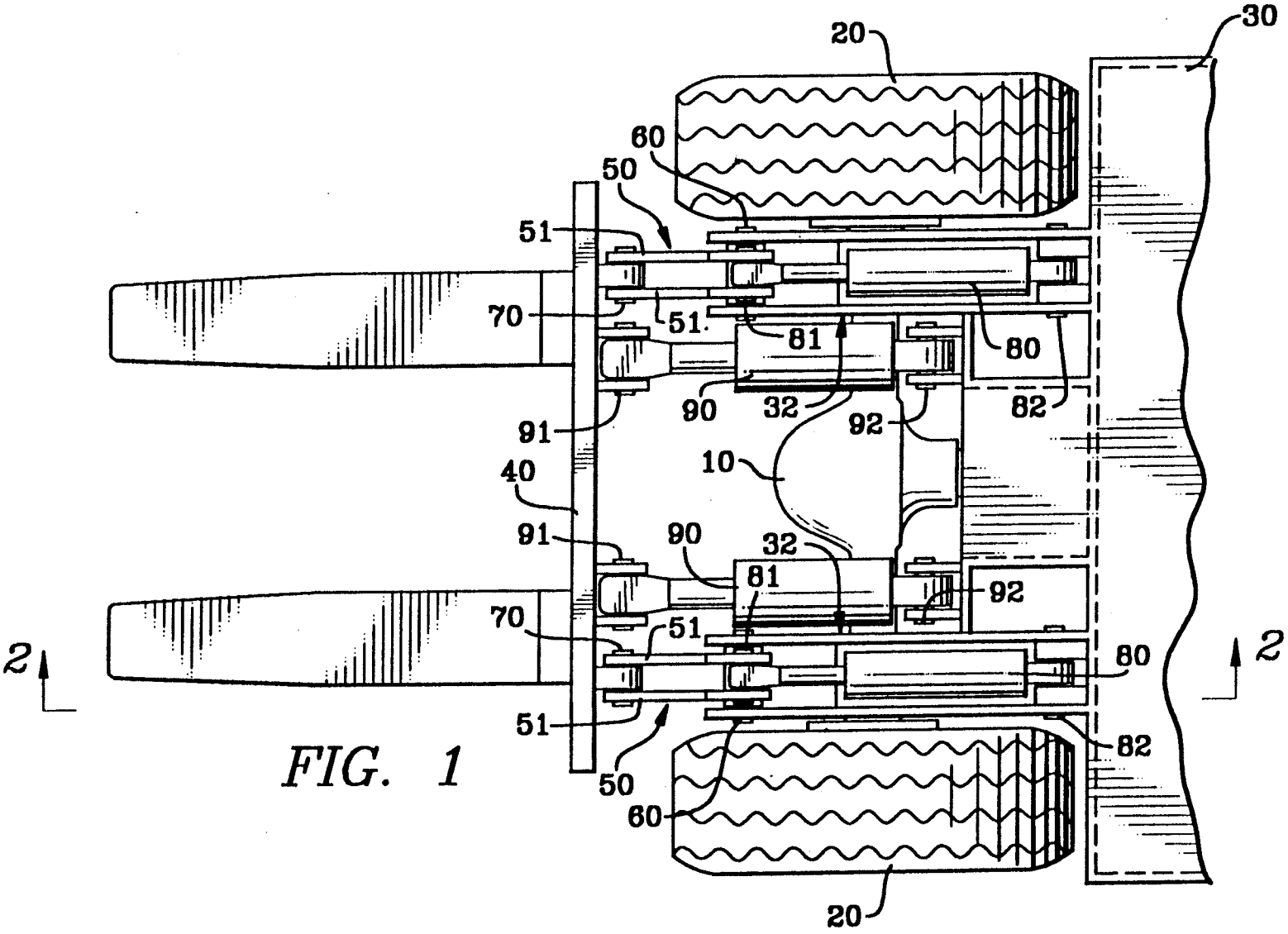
Figure 2:
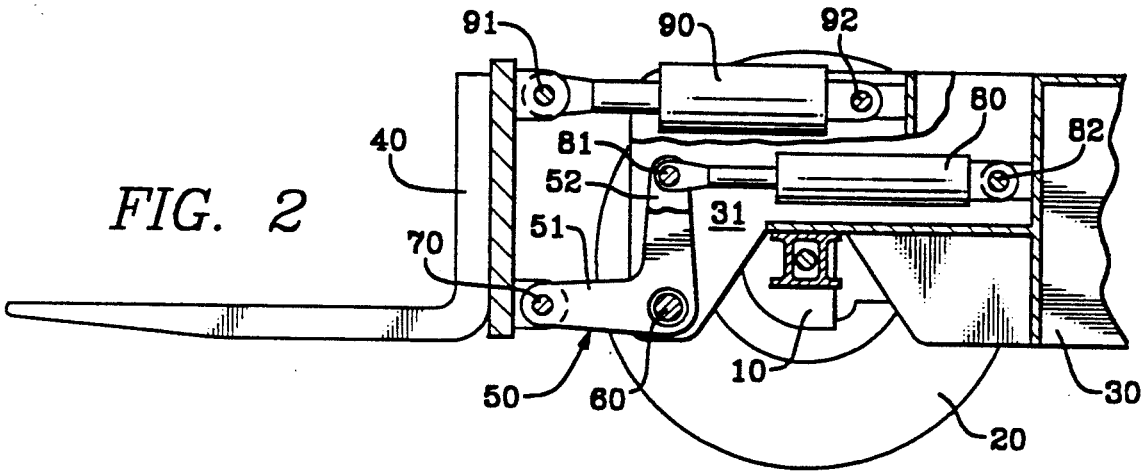

Referring to FIGS. 1 and 2, a front axle 10 and wheels 20 support a front part of vehicle main frame 30. A pair of identical bellcranks 50 are mounted pivotally, respectively, to lower ends of a left and a right extension 31 and 32 of vehicle main frame 30 through a first pair of coaxial pins 60. A vehicle load-carrying device comprising a fork 40 is mounted pivotally to substantially horizontal arms 51 of bellcranks 50 through a second pair of coaxial pins 70. A first pair of identical hydraulic cylinders 80 are connected pivotally to substantially vertical arms 52 of bellcranks 50 and to main frame 30, respectively, through a first pair of rod-end pins 81 and a first pair of cylinder pins 82. A second pair of identical hydraulic cylinders 90 are connected pivotally to fork 40 and main frame 30, respectively, through a second pair of rod-end pins 91 and a second pair of cylinder pins 92. All the pairs of pins are parallel.

When the first pair of hydraulic cylinders 80 are actuated to retract or extend, they will rotate, respectively, the pair of bellcranks 50 around the first pair of coaxial pins 60 in one or the other direction. During the rotation of the bellcranks, the second pair of coaxial pins 70 will move in an arch around the first pair of coaxial pins. Since the fork 40 is pivotally connected to the bellcranks as well as to the second pair of hydraulic cylinders 90, during the rotation of the bellcranks, the second pair of hydraulic cylinders will rotate around the second pair of cylinder pins 92. If the second pair of hydraulic cylinders 90 are not actuated hydraulically during the rotation of the bellcranks, they will act as rigid rod connections between the fork and the main frame. However, the combined rotations of the bellcranks 50 and second hydraulic cylinders 90 will produce a motion of the fork characterized by a significant change of the vertical position and an insignificant change of the angular position of the fork. Nevertheless, the angular position of the fork relative to the horizontal, or to ground surface, can be corrected at each point of elevation of the fork by the extending or retracting of the second pair of hydraulic cylinders 90.

From FIGS. 1 and 2 and the description, it is clear that the left side and the right side of the described load-lifting system are identical. In most cases, a system such as the one described, having two bellcranks and two pair of hydraulic cylinders, may be necessary for providing enough stable support of the load-carrying device. However, if a single bellcrank is centrally located and if it is wide enough to support the load-carrying device, a load lifting system according to this invention can have only one bellcrank, one first hydraulic cylinder, one second hydraulic cylinder and respective connecting pins in the same relationship as described above.

From the foregoing, it can be seen that the above-described invention provides an apparatus and a system for loading and unloading a load onto and from a load-carrying device, which is capable of producing a significant lift of the load and changing the angular position of the load at different load elevations.

Having described the invention, what is claimed is:

1. A load lifting system for vehicles, particularly for low profile underground mining vehicles having a front axle and wheels supporting a main vehicle frame and a load-carrying device, said load lifting system comprising:

a bellcrank which supports said load-carrying device;

a first pin which pivotally mounts said bellcrank to said main frame;

a second pin which pivotally mounts said load-carrying device to said bellcrank;

a first hydraulic cylinder connected between said frame and said bellcrank which pivots said bellcrank around said first pin;

a second hydraulic cylinder connected between said frame and said load-carrying device which pivots said load-carrying device around said second pin;

said first and second hydraulic cylinders being positioned above said axle, and said first pin being positioned below said axle, wherein said first and second cylinders are operable to change the vertical position of said load-carrying device without changing its angular orientation relative to the ground.

2. A load lifting system according to claim 1, wherein said load-carrying device is a scoop.

3. A load lifting system according to claim 1, wherein said load carrying device is a bucket.

4. A load lifting system according to claim 1, wherein said load carrying device is a platform.

5. A load lifting system according to claim 1, wherein said load carrying device is a fork.

* * * * *